US009650717B2

(12) United States Patent
Iwai et al.

(10) Patent No.: US 9,650,717 B2
(45) Date of Patent: May 16, 2017

(54) PRE-TREATMENT METHOD OF PLATING, STORAGE MEDIUM, AND PLATING SYSTEM

(71) Applicant: Tokyo Electron Limited, Tokyo (JP)

(72) Inventors: Kazutoshi Iwai, Nirasaki (JP); Nobutaka Mizutani, Nirasaki (JP); Mitsuaki Iwashita, Nirasaki (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 66 days.

(21) Appl. No.: 14/633,319

(22) Filed: Feb. 27, 2015

(65) Prior Publication Data

US 2015/0247242 A1 Sep. 3, 2015

(30) Foreign Application Priority Data

Feb. 28, 2014 (JP) ..... 2014-039042

(51) Int. Cl.
*C23C 18/18* (2006.01)
*C23C 18/16* (2006.01)

(52) U.S. Cl.
CPC ..... *C23C 18/1865* (2013.01); *C23C 18/165* (2013.01); *C23C 18/1675* (2013.01); *C23C 18/1817* (2013.01); *C23C 18/1844* (2013.01); *C23C 18/1893* (2013.01); *C23C 18/1651* (2013.01)

(58) Field of Classification Search
CPC ..... C23C 18/1872; C23C 18/1875; C23C 18/1879; C23C 18/1882; C23C 18/1886; C23C 18/1889; C23C 18/1893
See application file for complete search history.

(56) References Cited

U.S. PATENT DOCUMENTS

2009/0056994 A1* 3/2009 Kuhr ..... C23C 18/1653 174/259
2012/0174945 A1* 7/2012 Saio ..... H01L 21/02068 134/4

FOREIGN PATENT DOCUMENTS

| | | | |
|---|---|---|---|
| JP | 10-247785 | A | 9/1998 |
| JP | 2002-302773 | A | 10/2002 |
| JP | 2009-285995 | A | 12/2009 |
| JP | 2010-538159 | A | 12/2010 |
| JP | 2013-204071 | A | 10/2013 |
| WO | 2009/029863 | A1 | 3/2009 |

* cited by examiner

*Primary Examiner* — Nathan Empie
(74) *Attorney, Agent, or Firm* — Pearne & Gordon LLP

(57) ABSTRACT

A pre-treatment method of plating and a plating system can perform a uniform plating process in which sufficient adhesivity on a surface of a substrate is obtained. The pre-treatment method of plating includes a coupling layer forming process of forming a titanium-based coupling layer 21*b* on the surface of the substrate with a titanium coupling agent; and a coupling layer modification process of modifying a surface of the titanium-based coupling layer 21*b* with a modifying liquid after the coupling layer forming process.

5 Claims, 5 Drawing Sheets

PRE-TREATMENT METHOD OF PLATING, STORAGE MEDIUM, AND PLATING SYSTEM

CROSS-REFERENCE TO RELATED APPLICATION

This application claims the benefit of Japanese Patent Application No. 2014-039042 filed on Feb. 28, 2014, the entire disclosures of which are incorporated herein by reference.

TECHNICAL FIELD

The embodiments described herein pertain generally to a method of performing a pre-treatment as a surface treatment before filling a recess formed in a substrate by plating.

BACKGROUND

Recently, semiconductor devices such as a LSI or the like have been required to have higher density in order to meet requirements for reducing the mounting space or for improving the processing rate. As an example of a technology that achieves the high density, there has been known a multilayer wiring technology of manufacturing a multilayer substrate, such as a three-dimensional LSI or the like, by stacking multiple wiring substrates.

According to the multilayer wiring technology, a TSV (Through Silicon Via), which penetrates the wiring substrates and in which a conductive material such as copper (Cu) is buried, is typically formed in the wiring substrate in order to obtain electrical connection between the wiring substrates. As an example of a technology for forming the TSV in which a conductive material is buried, there has been known an electroless plating method.

In case of forming a metal film by the electroless plating, it is required to improve adhesivity between a base and the metal layer. For the purpose, conventionally, a self-assembled monolayer (SAM) is formed on the base by using a coupling agent such as a silane coupling agent or a titanium coupling agent, and a metal catalytic particle such as a palladium particle is provided on the base with the self-assembled monolayer therebetween (see, for example, Patent Document 1).

In general, since a main component of the titanium coupling agent is $TiO_x$, a performance of adsorption of the metal catalytic particle is superior. For this reason, adhesivity of the metal film can be improved by forming a titanium coupling agent-based coupling layer with the titanium coupling agent.

As such, conventionally, the metal catalytic particle is coupled onto the titanium coupling agent-based coupling layer, and then, the metal film is formed by the electroless plating with the metal catalytic particle. However, there may be a case where the metal catalytic particle is not sufficiently coupled to the coupling layer due to a surface shape of the coupling layer. In this case, even if the metal film is formed by the electroless plating with the metal catalytic particle, it is difficult to securely form the metal film with a high precision.

Patent Document 1: Japanese Patent Laid-open Publication No. 2002-302773

SUMMARY

In view of the foregoing, the example embodiment provides a pre-treatment method of plating which can form a uniform metal film having sufficient adhesivity by electroless plating, a storage medium, and a plating system.

In one example embodiment, a pre-treatment method of plating includes a preparing process of preparing a substrate; a coupling layer forming process of forming a titanium-based coupling layer on a surface of the substrate with a titanium coupling agent; and a coupling layer modification process of modifying a surface of the titanium-based coupling layer by cleaning the surface of the titanium-based coupling layer with a modifying liquid.

In another example embodiment, a computer-readable storage medium has stored thereon computer-executable instructions that, in response to execution, cause a plating system to perform a pre-treatment method of plating. Further, the pre-treatment method of plating includes a preparing process of preparing a substrate; a coupling layer forming process of forming a titanium-based coupling layer on a surface of the substrate with a titanium coupling agent; and a coupling layer modification process of modifying a surface of the titanium-based coupling layer by cleaning the surface of the titanium-based coupling layer with a modifying liquid.

In yet another example embodiment, a plating system includes a coupling layer forming unit configured to form a titanium-based coupling layer on a surface of a substrate with a titanium coupling agent; and a coupling layer modification unit configured to modify a surface of the titanium-based coupling layer by cleaning the surface of the titanium-based coupling layer with a modifying liquid.

In accordance with the example embodiment, it is possible to securely couple the metal catalytic particle onto the titanium-based coupling layer by modifying the surface of the titanium-based coupling layer having a surface of, for example, a protrusion/recess shape to have a flat shape. Thus, it is possible to form a uniform metal film having sufficient adhesivity by the electroless plating with the metal catalytic particle.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1A:
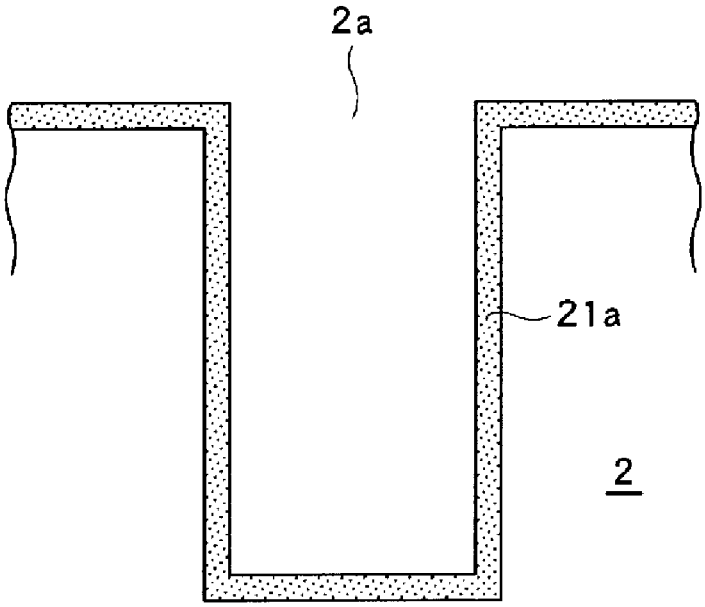
FIG. 1A and FIG. 1B are cross sectional views of a substrate in the vicinity of a recess in order to explain a silane coupling process and a titanium coupling process.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

Hereinafter, a series of processes of burying Cu (copper) in a recess (a recess to be formed as a TSV (Through Silicon Via)) formed on a substrate will be described in detail with reference to the accompanying drawings. These series of processes include respective processes of a pre-treatment method of plating in accordance with an example embodiment.

A substrate (silicon substrate) 2 having a previously formed recess (hole) 2*a* to be formed as a TSV is prepared.

The recess 2*a* may be formed by a commonly known dry etching process using, for example, photolithography. As one example, the recess 2*a* may be formed by ICP-RIE (Inductively Coupled Plasma Reactive Ion Etching). Otherwise, a TEOS film may be formed on the silicon substrate 2 and then, the recess 2*a* may be formed in the TEOS film.

Below, the pre-treatment of plating will be discussed.

(Hydrophilic Process)

First, a hydrophilic process is performed on the substrate 2. The hydrophilic process may be implemented by any of various commonly known methods such as a UV (Ultraviolet) irradiation process, a plasma oxidation process, a SPM process (piranha cleaning), and so forth. Through this hydrophilic process, a surface of the substrate is turned into a state where a coupling agent to be described later can be easily coupled to the surface of the substrate. In case that the hydrophilic process is implemented by the SPM process, a rinse process by DIW (pure water) is performed after the SPM process.

(Silane Soupling Process)

Subsequently, a silane coupling process, in which a silane-based coupling layer 21*a* (see FIG. 1A) is formed on the surface of the substrate including an inner surface of the recess 2*a* by adsorbing a silane coupling agent, is performed.

Here, the term "silane-based coupling layer" implies a layer composed of a self-assembled monolayer formed from a silane coupling agent. This silane-based coupling layer is provided between a base (here, silicon) and an upper layer (a catalytic particle-containing layer 22 to be described later), and enhances the coupling therebetween.

Figure 3A:
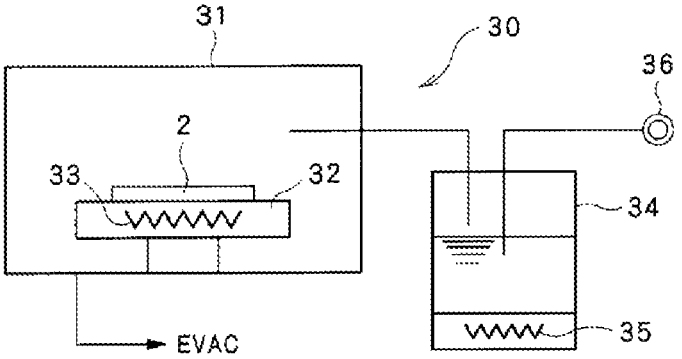
FIG. 3A to FIG. 3D are diagrams schematically illustrating configurations of apparatuses used in a pre-treatment of plating.

In the present example embodiment, the silane coupling process is implemented by a vacuum deposition process. The vacuum deposition process may be performed by using a vacuum deposition apparatus 30 having a configuration schematically illustrated in FIG. 3A, for example. In this apparatus, the substrate 2 is mounted on a mounting table 32 provided within a processing chamber 31 in a vacuum (decompressed) atmosphere, and the substrate 2 is heated to, e.g., 100° C. by a heater 33 embedded in the mounting table 32. In this state, a silane coupling agent stored in a liquid state within a tank 34 is heated and vaporized by a heater 35 to be supplied into the processing chamber 31 by being carried with a carrier gas supplied from a carrier gas supply source 36.

Alternatively, the silane coupling process may be implemented by a liquid process. As the liquid process, a spin-on process using a spinner (a spin-type liquid processing apparatus) to be used in a titanium coupling process to be described later, an immersion process of immersing a substrate in a bath filled with a silane-coupling agent, or the like may be used. Further, in case of performing the silane coupling process through such a liquid process, a bake process needs to be additionally performed before the subsequent titanium coupling process is conducted.

If an aspect ratio of the recess 2*a* is high (for example, if the recess 2*a* is a TSV having a high aspect ratio as in the present example embodiment), it may be very difficult or impossible to allow the silane coupling agent to reach a bottom of the recess 2*a* through the liquid process, or it may take a long time from the viewpoint of manufacturing technology. Thus, it may be desirable to implement the silane coupling process by the vacuum deposition process. For this reason, the silane coupling process in this example embodiment is implemented by the vacuum deposition process.

A state where the silane coupling process is completed is depicted in FIG. 1A. A film formed from the silane coupling agent, i.e., the silane-based coupling layer 21*a* is formed on the entire inner surface of the recess 2*a* and on the entire surface (top surface) of the substrate 2 at an outside of the recess 2*a*.

(Titanium Coupling Process)

Now, the titanium coupling process of forming a titanium-based coupling layer 21*b* (see FIG. 1B) by adsorbing a titanium coupling agent to the surface of the substrate including the inner surface of the recess is performed. Here, the term "titanium-based coupling layer" refers to a film composed of a self-assembled monolayer formed from a titanium coupling agent. This titanium-based coupling layer is provided between the base and the upper layer and enhances the coupling therebetween.

The titanium coupling process may be implemented by a liquid process. As the liquid process, an immersion process of immersing the substrate in a bath filled with a titanium-coupling agent or a spin-on process using a spinner (a spin-type liquid processing apparatus) 40 serving as a coupling layer forming unit and having a configuration schematically illustrated in FIG. 3B, or the like may be used. In the present example embodiment, the titanium coupling process is performed through the spin-on process.

Figure 3B:
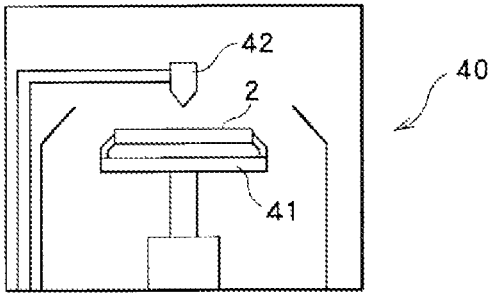

The spin-on process involves rotating the substrate 2 horizontally held on a spin chuck 41 about a vertical axis line and discharging a titanium coupling agent toward a central portion of the substrate 2 from a nozzle 42, as depicted in FIG. 3B. The titanium coupling agent in a liquid state discharged onto the central portion of the surface of the substrate 2 is diffused onto a peripheral portion of the substrate by a centrifugal force, so that a film formed from the titanium coupling agent, i.e., the titanium-based coupling layer 21*b* is formed on the surface of the substrate. This process may be performed in the air at a room temperature.

In the present example embodiment, the titanium coupling agent is not intended to reach the inside of the recess 2*a* for the reasons as will be described in detail later. Thus, the spin-on process is more desirable than the immersion process, since it is possible to suppress the titanium coupling agent from entering the recess 2*a* by controlling a rotational number in the spin-on process.

Figure 1B:
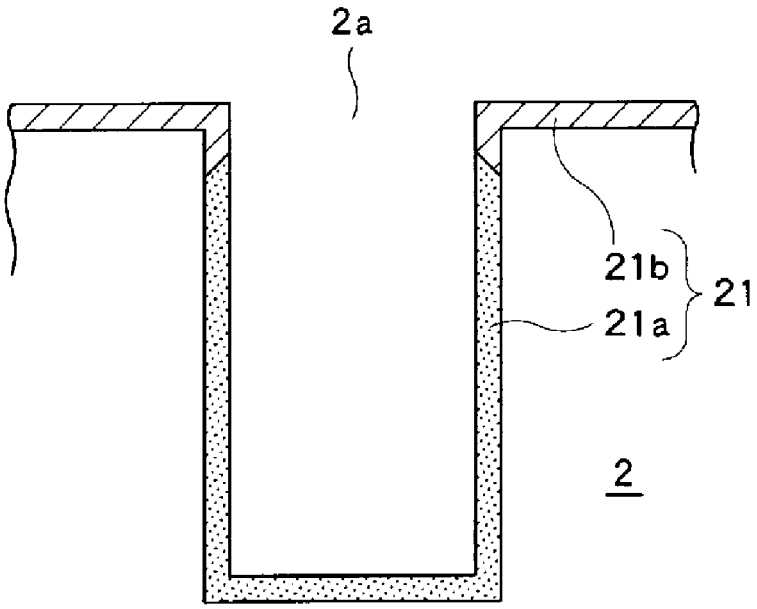

Upon the completion of the titanium coupling process, the silane-based coupling layer 21*a* and the titanium-based coupling layer 21*b* are found to be formed on the inner surface of the recess 2*a* and in the vicinity thereof, as schematically illustrated in FIG. 1B. A portion of the previously formed silane-based coupling layer 21*a* on which the titanium coupling process is performed is converted to the titanium-based coupling layer 21*b*. This will be elaborate later.

(First Baking Process)

Upon the completion of the titanium coupling process, a first baking process for the titanium coupling agent is performed. This first baking process may be implemented by heating the substrate under a low oxygen atmosphere, e.g., under a nitrogen gas atmosphere. To elaborate, by using a heating apparatus (bake apparatus) 50 serving as a first baking unit and having a configuration schematically illustrated in FIG. 3C, for example, the substrate 2 is mounted on a mounting table 52 provided within a processing chamber 51 under a nitrogen gas atmosphere, and the substrate 2 is heated to, e.g., 100° C. by a heater 53 embedded in the mounting table 52. Through the first baking process, the titanium-based coupling layer 21*b* formed between the base and an upper layer can enhance the coupling between the base and the upper layer.

(Coupling Layer Modification Process)

Then, a surface of a coupling layer 21 composed of the silane-based coupling layer 21*a* and the titanium-based coupling layer 21*b* is processed by supplying a modifying liquid thereto.

In this case, as the modifying liquid, any one of DHF (fluorine-based solvent) having a concentration of 0.1% or TMAH (alkaline solvent) having a concentration of 1% may be used.

That is, by supplying the modifying liquid to the substrate 2 and processing the surface of the substrate 2 with the modifying liquid, the surface of the coupling layer 21, particularly, the titanium-based coupling layer 21*b* formed outside the recess 2*a* can be processed. For this reason, the surface of the titanium-based coupling layer 21*b* can be modified by processing the surface of the titanium-based coupling layer 21*b* on the substrate 2 with the modifying liquid.

To be specific, before the process using the modifying liquid is performed, the surface of the titanium-based coupling layer 21*b* has a protrusion/recess shape 5. However, by supplying the modifying liquid onto the titanium-based coupling layer 21*b*, protruding portions of the protrusion/recess shape 5 can be removed with the modifying liquid. As a result, the titanium-based coupling layer 21*b* can have a flat shape 6.

For this reason, as described below, a metal catalytic particle can be stably coupled onto the surface of the titanium-based coupling layer 21*b* having the flat shape 6.

Figure 3C:
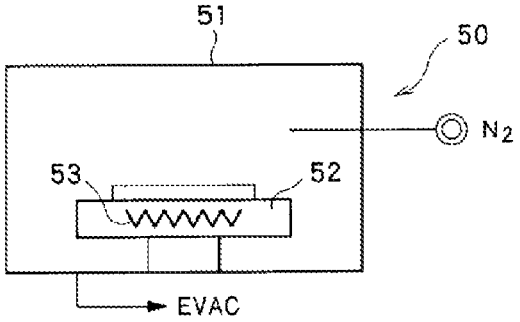
Figure 3D:
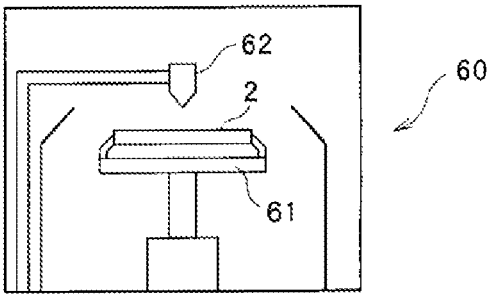

The coupling layer modification process may be performed by a liquid process. As the liquid process, an immersion process of immersing the substrate 2 in a bath filled with the modifying liquid or a spin-on process with a spinner (a spin-type liquid processing apparatus) 60 serving as a coupling layer modification unit and having a configuration as schematically depicted in FIG. 3D. In the present example embodiment, the coupling layer modification process is performed by the spin-on process.

The spin-on process involves rotating the substrate 2 horizontally held on a spin chuck 61 about a vertical axis line and discharging the modifying liquid toward the central portion of the substrate 2 from a nozzle 62, as depicted in FIG. 3D. The modifying liquid in a liquid state discharged onto the central portion of the surface of the substrate 2 is diffused onto the peripheral portion of the substrate by a centrifugal force, so that a film formed from the modifying liquid is formed on the surface of the substrate. As such, the surface of the titanium-based coupling layer 21*b* of the coupling layer 21 is processed. This process may be performed in the air at a room temperature.

In the present example embodiment, the modifying liquid is not intended to reach the inside of the recess 2*a*. Thus, the spin-on process is more desirable than the immersion process, since it is possible to suppress the modifying liquid from entering the recess 2*a* by controlling a rotational number in the spin-on process.

As such, the surface of the coupling layer 21, particularly, the titanium-based coupling layer 21*b* formed outside the recess 2*a* is processed with the modifying liquid. As a result, the surface of the titanium-based coupling layer 21*b* is processed to have the flat shape 6.

(Second Baking Process)

Upon the completion of the coupling layer modification process, a second baking process is performed. The second baking process may be implemented by heating the substrate under a low oxygen atmosphere, e.g., under a nitrogen gas atmosphere in the same manner as the first baking process. To elaborate, by using the heating device (baking apparatus) 50 serving as a second baking unit and having the configuration as schematically illustrated in FIG. 3C, for example, the substrate 2 is mounted on the mounting table 52 provided within the processing chamber 51 under a nitrogen gas atmosphere, and the substrate 2 is heated to, e.g., 100° C. by the heater 53 embedded in the mounting table 52. Through the second baking process, the modification process performed on the titanium-based coupling layer 21*b* is ended. By performing the second baking process, the effect of the coupling layer modification process can be further improved. Thus, in a catalytic particle-containing film forming process to be subsequently performed, it is possible to securely and stably couple the metal catalytic particle to the surface of the titanium-based coupling layer 21*b*.

Figure 2A:
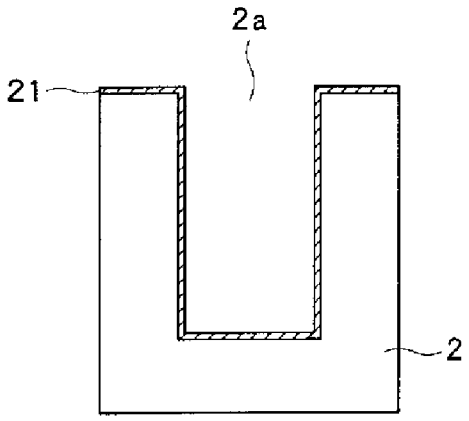
FIG. 2A to FIG. 2F are cross sectional views of the substrate in the vicinity of a recess in order to explain a TSV forming process.

The subsequent processes will be explained with reference to FIG. 2A to FIG. 2F. In FIG. 2A to FIG. 2F, for the simplicity of illustration, the silane-based coupling layer 21*a* and the titanium-based coupling layer 21*b* are represented by the single coupling layer 21 without being distinguished from each other. FIG. 2A illustrates a state where the second baking process is completed.

(Catalytic Particle-Containing Film Forming Process)

Subsequently, the catalytic particle-containing film forming process is performed. In this process, a Pd nano-colloid liquid prepared by dispersing Pd nanoparticles as catalytic metal particles and PVP (Polyvinylpyrrolidone) as a dispersing agent for coating the Pd nanoparticles in a solvent, i.e., a catalytic particle liquid is supplied onto the substrate.

Figure 2B:
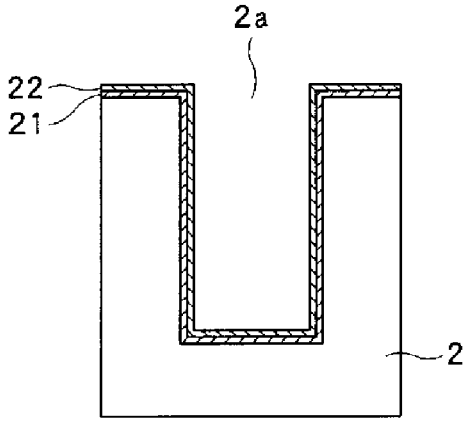

The catalytic particle-containing film forming process may be performed by using the spinner 40 serving as a catalytic particle-containing film forming unit and having the configuration schematically illustrated in FIG. 3B, for example. The substrate 2 horizontally held on the spin chuck 41 is rotated about a vertical axis line, and a catalytic particle liquid is discharged toward the central portion of the rotating substrate 2 from a nozzle. As a result, as depicted in FIG. 2B, a catalytic particle-containing film 22 containing the catalytic metal particles is formed on the coupling layer 21 at the inner surface of the recess 2*a* and at the surface of the substrate 2 positioned outside of the recess 2*a*. In this case, the coupling layer 21, particularly, the titanium-based coupling layer 21*b* is modified to have the flat shape 6. Thus, it is possible to securely and stably couple the metal catalytic particle to the surface of the titanium-based coupling layer 21*b*.

(Heating Process)

Upon the completion of the catalytic particle-containing film forming process, a heating process is performed. The heating process may be implemented by heating the substrate 2 in a vacuum (decompressed) atmosphere. For example, the heating process is performed in the heating apparatus 50 serving as a heating unit and having the configuration schematically illustrated in FIG. 3C. To elaborate, the substrate 2 is mounted on the mounting table 52 within the processing chamber 51 under a vacuum (decompressed) atmosphere (only evacuation is performed without supplying a nitrogen gas) and is heated to a temperature of 100° C. to 280° C. By performing the heating process, the catalytic particle-containing film 22 is found to be strongly coupled to the coupling layer 21.

Through the above-described processes, the pre-treatment of plating is completed.

(Barrier Layer Forming Process)

Figure 2C:
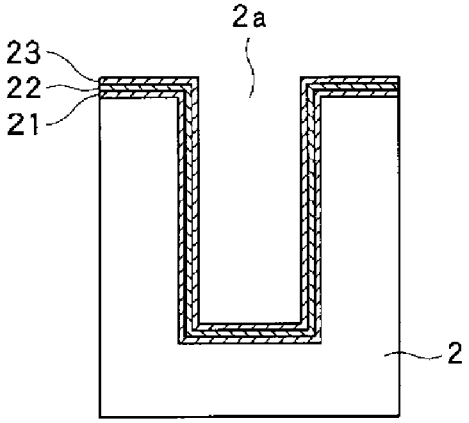

Upon the completion of the heating process, a Co-W-based barrier layer 23 (containing cobalt and tungsten) is formed by the commonly known electroless plating technology, as depicted in FIG. 2C. At this time, catalytic particles serve as a catalyst for the electroless plating.

(Seed Layer Forming Process)

Figure 2D:
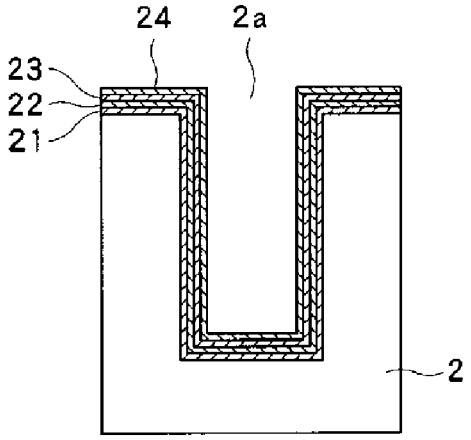

If the barrier layer forming process is completed, a Cu seed layer 24 is formed on the barrier layer 23 by a commonly known electroless plating technology, as depicted in FIG. 2D.

(Burying Process)

Figure 2E:
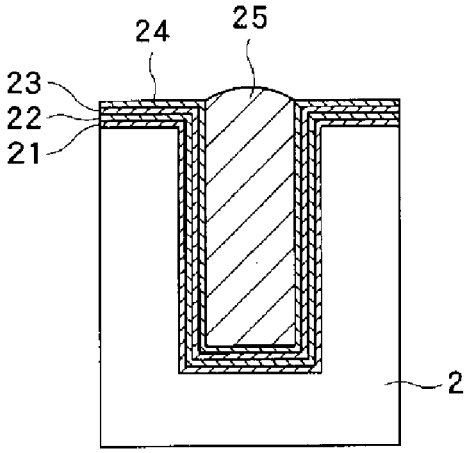
Figure 2F:
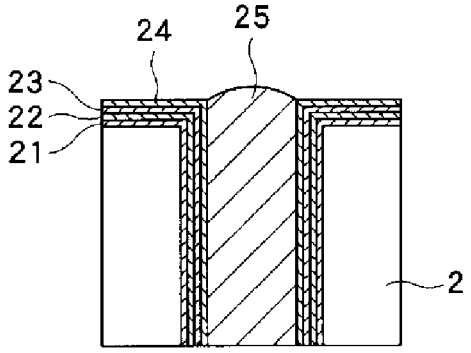

Upon the completion of the seed layer forming process, a Cu metal layer 25 is formed on the Cu seed layer 24 by the commonly known electroless plating technology, as depicted in FIG. 2E. At this time, the recess 2*a* is completely filled with the Cu metal layer 25.

If the burying process is finished, a rear surface of the substrate 2 is polished by the CMP, so that the Cu metal layer 25 is exposed on the rear surface of the substrate 2. Through the above-described processes, a series of TSV filling processes are completed.

In the above-described example embodiment, the catalytic metal particles contained in the catalytic particle liquid are palladium (Pd). However, the example embodiment is not limited thereto, and gold (Au), platinum (Pt), ruthenium (Ru), or the like may also be used, for example.

In the present example embodiment, the dispersing agent contained in the catalytic particle liquid is polyvinylpyrrolidone (PVP). However, the example embodiment is not limited thereto, and polyacrylic acid (PAA), polyethyleneimine (PEI), tetramethylammonium (TMA), citric acid, or the like may also be used, for example.

In the above-described example embodiment, the heating process is performed in the low oxygen atmosphere having a low oxygen concentration or in the vacuum atmosphere. However, the heating process may be performed in the atmospheric (air) atmosphere. In such a case, the adhesivity tends to be lower than that in case of performing the heating process in the low oxygen atmosphere having the low oxygen concentration or in the vacuum atmosphere. However, if the reduced level of the adhesivity is acceptable, it is desirable that the heating process is performed in the atmospheric (air) atmosphere to reduce the processing cost.

In the above-described example embodiment, the barrier layer 23 is made of the Co—W-based material. However, the example embodiment may not be limited thereto, and the barrier layer may be formed of a commonly known appropriate barrier material such as, but not limited to, Ni—W-based material (containing nickel and tungsten). Further, the barrier layer may be formed in two layers, as disclosed in Japanese Patent Laid-open Publication No. 2013-194306 filed by the present applicant prior to the filing of the present application.

In the above-described example embodiment, the seed layer 24 and the metal layer 25 are cooper (Cu). However, the seed layer 24 and the metal layer 25 may be, by way of example, but not limitation, tungsten (W), cobalt (Co), nickel (Ni) or an alloy thereof. The barrier layer 23 may be appropriately changed depending on the material of the seed layer 24 and the metal layer 25.

Further, in the above-described example embodiment, the recess 2*a* of the substrate 2 serves as a TSV. However, the example embodiment may not be limited thereto, and the recess may serve as a typical via or trench. Otherwise, it may not be necessary to form a recess in the substrate 2.

Figure 4:
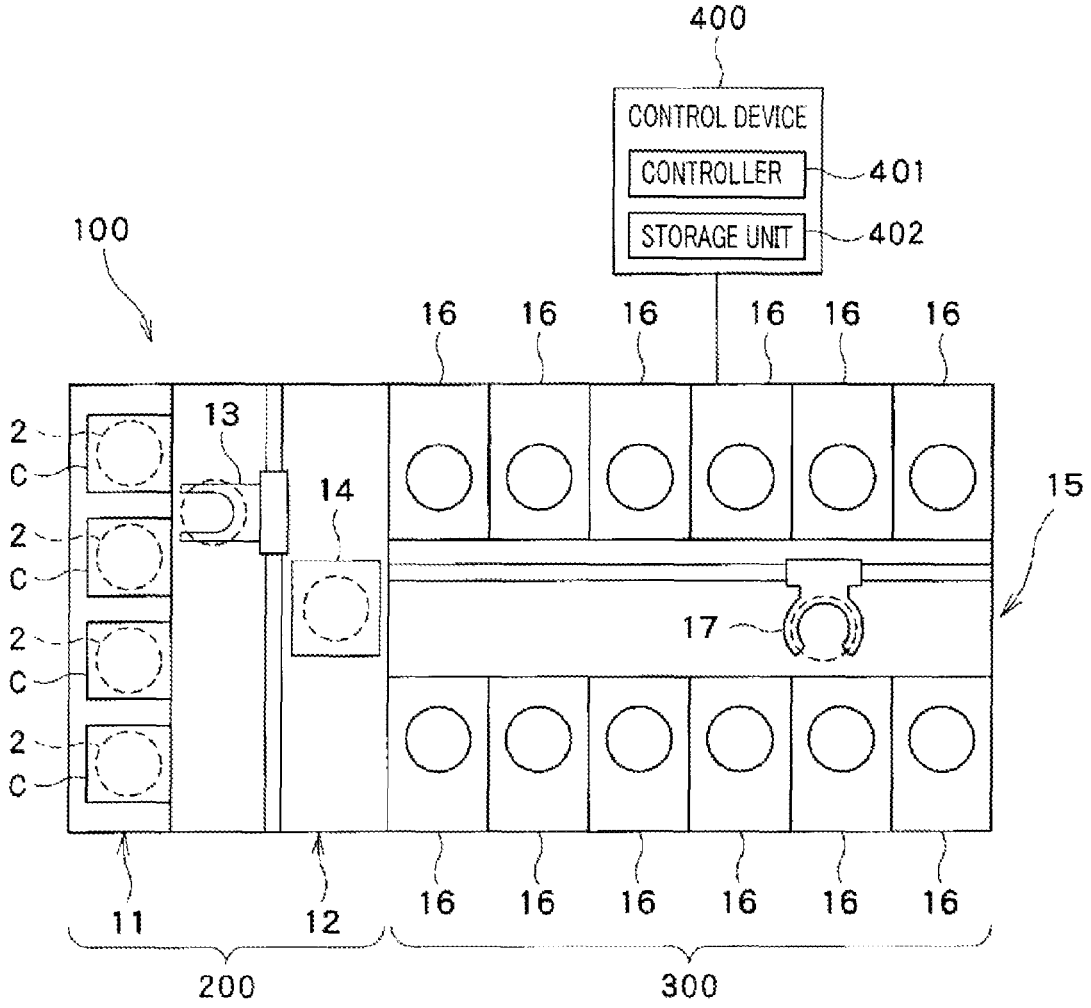
FIG. 4 is a schematic plane view illustrating an example configuration of a plating system of performing a series of processes including the pre-treatment of plating.
Figure 5A:
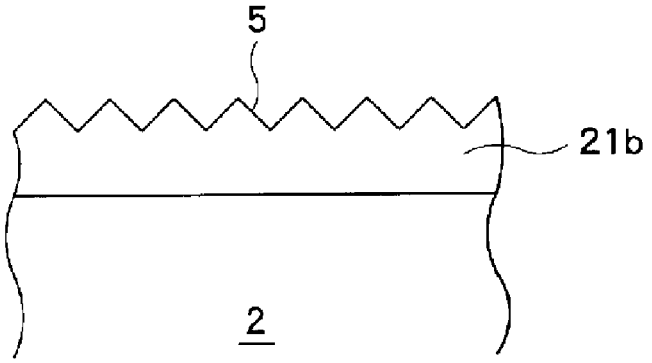
FIG. 5A and FIG. 5B are diagrams illustrating an operation of modifying a surface of a titanium-based coupling layer with a cleaning liquid.
Figure 5B:
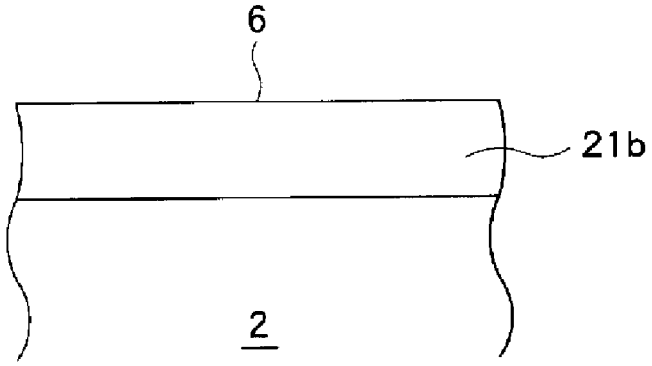

The above-described series of processes, i.e., the hydrophilic process, the silane coupling process, the titanium coupling process, the first baking process, the coupling layer modification process, the second baking process, the catalytic particle-containing film forming process, the heating process, the barrier layer forming process, the seed layer forming process and the burying process can be performed by, for example, a plating system schematically illustrated in FIG. 4.

In a plating system 100 shown in FIG. 4, a substrate transfer device 13 provided in a loading/unloading station 200 is configured to take out a substrate 2 from a carrier C mounted on a carrier mounting unit 11 to mount the substrate 2 on a transit unit 14. Processing units 16 provided in a processing station 300 are configured to perform at least one of the above-described series of processes. That is, some of the processing units 16 are configured as the apparatuses 30, 40, 50 and 60 illustrated in FIG. 3A to FIG. 3D, respectively. The substrate 2 mounted on the transit unit 14 is taken out of the transit unit 14 by a substrate transfer device 17 of the processing station 300, and then, is loaded into the processing units 16 corresponding to the above-described processes in sequence. In each processing unit 16, a preset process is performed. After the series of processes are completed, the processed substrate 2 is unloaded from the processing unit 16 to be mounted on the transit unit 14. Then, the processed substrate 2 mounted on the transit table 14 is returned back into the carrier C in the carrier mounting unit 11 by the substrate transfer device 13.

The plating system 100 further includes a control device 400. The control device 400 is, for example, a computer and includes a controller 401 and a storage unit 402. The storage unit 402 stores therein programs for controlling various processes performed in the plating system 100. The controller 401 controls the operation of the plating system 100 by reading out a program from the storage unit 402 and executing the program. That is, the control device 400 controls the operations of the individual processing units 16 and the transfer operations for the substrate 2 by the substrate transfer devices 13 and 17 in order to perform the above-described series of processes related to the plating.

The programs may be stored in a computer-readable storage medium and installed on the storage unit 402 of the control device 400 from that storage medium. Here, the computer-readable storage medium may be, by way of example, but not limitation, a hard disk (HD), a flexible disk (FD), compact disk (CD), a magnet optical disk (MO) or a memory card.

(Experimental Example)

Hereinafter, a specific experimental example will be described.

In the present experimental example, a substrate is immersed in the modifying liquid, and then, a modified status of the titanium-based coupling layer is checked.

An immerging time period is varied in a range from 1 second to 60 seconds. As the modifying liquid, DHF and TMAH are used respectively.

Then, the number of adsorbed Pd and compactness of a CoWB metal film with respect to the substrate are evaluated by the SEM.

1. It is observed that when the substrate is immersed in the DHF for 5 seconds or longer, the compactness of the CoWB metal film is improved. Further, it is observed that even if a column-shaped CoWB layer of 40 nm or less is formed from an interface of the substrate, a continuous layer (CoWB) of 60 nm is formed thereon. On the DHF-processed substrate, the number of the adsorbed Pd is 7200/$\mu m^2$, and Pd is securely coupled thereto by modifying the surface thereof.

2. If the surface of the substrate is modified with the TMAH, a column-shaped layer of 40 nm to 50 nm is formed from the interface of the substrate and a continuous layer of 50 nm to 60 nm is formed thereon.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

We claim:

1. A pre-treatment method of plating, comprising:

a preparing process of preparing a substrate having a recess;

a coupling layer forming process of forming a titanium-based coupling layer on a surface of the substrate which is outside of the recess with a titanium coupling agent; and a coupling layer modification process of modifying a surface of the titanium-based coupling layer by cleaning the surface of the titanium-based coupling layer with a modifying liquid, wherein the coupling layer modification process is performed by a spin-on process with a spinner, and a rotation speed in the spin-on process is controlled to suppress the modifying liquid from entering the recess.

2. The pre-treatment method of plating of claim 1, wherein a fluorine-based liquid or an alkaline liquid is used as the modifying liquid.

3. The pre-treatment method of plating of claim 1, wherein a first baking process of baking the substrate at a first temperature is performed between the coupling layer forming process and the coupling layer modification process.

4. The pre-treatment method of plating of claim 1, wherein a second baking process of baking the substrate at a second temperature is performed after the coupling layer modification process.

5. The pre-treatment method of plating of claim 1, further comprising:

a coupling process of coupling a metal catalytic particle to the surface of the titanium-based coupling layer after the coupling layer modification process.

* * * * *